United States Patent [19]

Riccard

[11] 4,287,816

[45] Sep. 8, 1981

[54] VENTILATOR SHROUD

[76] Inventor: Theodore M. Riccard, 605 Lavon Dr., Altamonte Springs, Fla. 32701

[21] Appl. No.: 83,599

[22] Filed: Oct. 11, 1979

[51] Int. Cl.[3] ..... F24F 13/08

[52] U.S. Cl. ..... 98/119; 98/75; 98/122; 220/4 B; 416/146 R

[58] Field of Search ..... 98/69, 72, 75, 119, 98/122, 15, 34; 150/52 R; 138/96 R, 178; 220/4 E, 4 F, 85 P, 4 B; 416/146 R, 227 A; 292/202, 213

[56] References Cited

U.S. PATENT DOCUMENTS 1,191,172 7/1916 Fuller ..... 292/202

2,593,533 4/1952 Cammarato ..... 220/85 P 4,051,770 10/1977 Felter et al. ..... 98/69 X

*Primary Examiner*—Albert J. Makay

*Assistant Examiner*—Harold Joyce

*Attorney, Agent, or Firm*—Stanley J. Klem

[57] ABSTRACT

A durable shroud is provided for roof ventilators to prevent warm air from escaping through ventilators openings as well as to provide a protective cover for the ventilator in inclement weather. The ventilator is comprised of two hemispherical segments that are coupled to form a complete hemisphere about a roof ventilator. Therefore, weather elements are prevented from contacting the ventilator and heat from within is prevented from escaping through the ventilator openings.

1 Claim, 6 Drawing Figures

VENTILATOR SHROUD

BACKGROUND OF THE INVENTION

The present invention relates to protective devices for ventilators and more specifically to a shroud for roof ventilators.

The present invention also represents a substantial improvement over previous methods of protecting roof ventilators and preventing heat loss.

Free flow roof turbines or ventilators are commonly utilized to inexpensively exhaust dormant hot air from attics or other space under a roofed area. They are also used to evacuate warm air from such areas as kitchens or laundries.

Roof ventilators are generally constructed of a plurality of curvilinear blades supported in a freely rotatable frame. The blades are contoured and oriented in relation to one another such that warm air rising from below, passes through the blades and due to the blade orientation, urges the blades and consequently the frame to rotate and expel the warm air.

This principle, although very effective in the summer months, was equally effective, but undesirable, in the winter months due to the significant heat losses in the winter. Heat generally escapes from homes during cold weather but the additional heat loss caused by heat being expelled from a home by the roof ventilator is costly and efforts to prevent heat loss are somewhat less than effective.

For example, one attempt to prevent heat loss was to cover the ventilator with a plastic bag which was tied at the bottom. Although generally very effective, the bags were usually destroyed by severe winds which are common in the winter. It therefore becomes necessary to replace the covering and to accomplish this, one had to climb to the roof. This operation would be repeated as often as the covering was destroyed which may be several times during the winter.

The applicant's device overcomes the disadvantages of previous attempts to reduce heat loss in that it is a durable ventilator covering that can be easily installed and removed; it will not require replacement; and minimizes the hazards of climbing the roof during severe weather.

SUMMARY OF THE INVENTION

The inventive concept disclosed contemplates the method and means for minimizing heat loss as a result of heat expelled by roof ventilators. The present concept provides for a dual hemispherically contoured durable housings that are easily installed about a roof ventilator. The housings are constructed of rigid material and the opening periphery of each includes a projecting flange. Pivotally attached to the upper and lower portion of one housing is a channeled latching member. When the housings are disposed about a roof ventilator, the projecting flanges are aligned and in contact with one another. The channel latching members are then pivoted into position to overlie and engage both flanges of the housings and thereby lock the housings together to define an enclosure about the ventilator. Other objects, features and advantages of the invention will become more apparent from the following description, including apppended claims, and accompanying drawing.

DESCRIPTION OF THE PREFERRED EMBODIMENT

Figure 1:
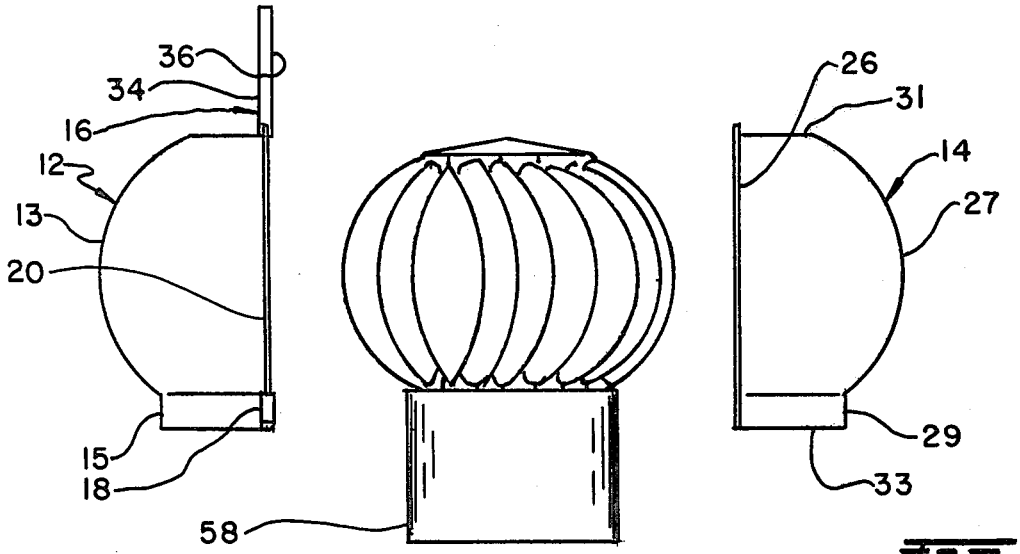
FIG. 1 is an elevation view of the ventilator shroud embodied in the invention showing it in relation to a roof ventilator.

Referring now to the drawings, there is shown a ventilator shroud 10 that includes a first hemispherical segment 12, a second hemispherical segment 14, an upper latch 16 and a lower latch 18.

Figure 2:
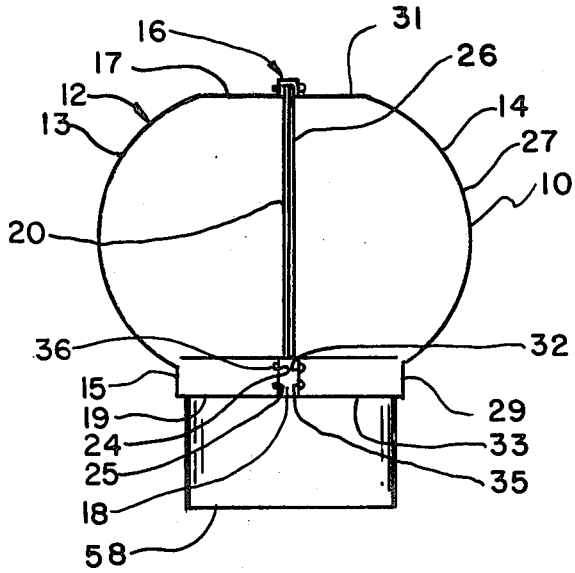
FIG. 2 is an elevation view of the invention assembled about a roof ventilator.
Figure 3:
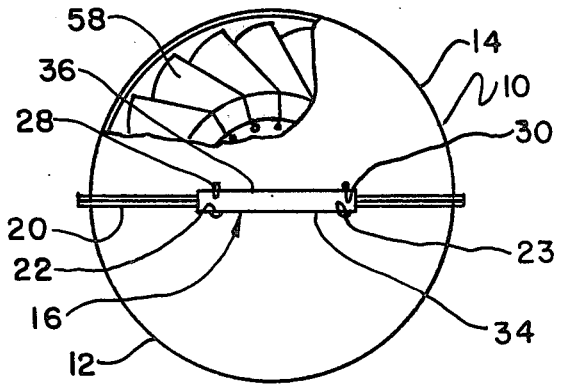
FIG. 3 is a top view of FIG. 2.

Segment 12 includes an upper hemispherical portion 13 and a lower cylindrical portion 15. Segment 12 is substantially flat at a topmost part 17 and open at a lowermost part 19. An outward projecting flange 20, disposed along the periphery of the segment cavity, includes upper apertures 22 and 23 best shown in FIGS. 3, 4 and 6 and apertures 24 and 25 best shown in FIGS. 2 and 5.

Segment 14 includes an upper hemispherical portion 27 and a lower cylindrical portion 29. Segment 14 is substantially flat at a topmost part 31 and open at a lowermost part 33. An outward projecting flange 26, disposed along the periphery of the segment cavity, includes upper apertures 28 and 30 best shown in FIGS. 3 and 6 and lower apertures 32 and 35 best shown in FIGS. 2 and 5.

Figure 4:
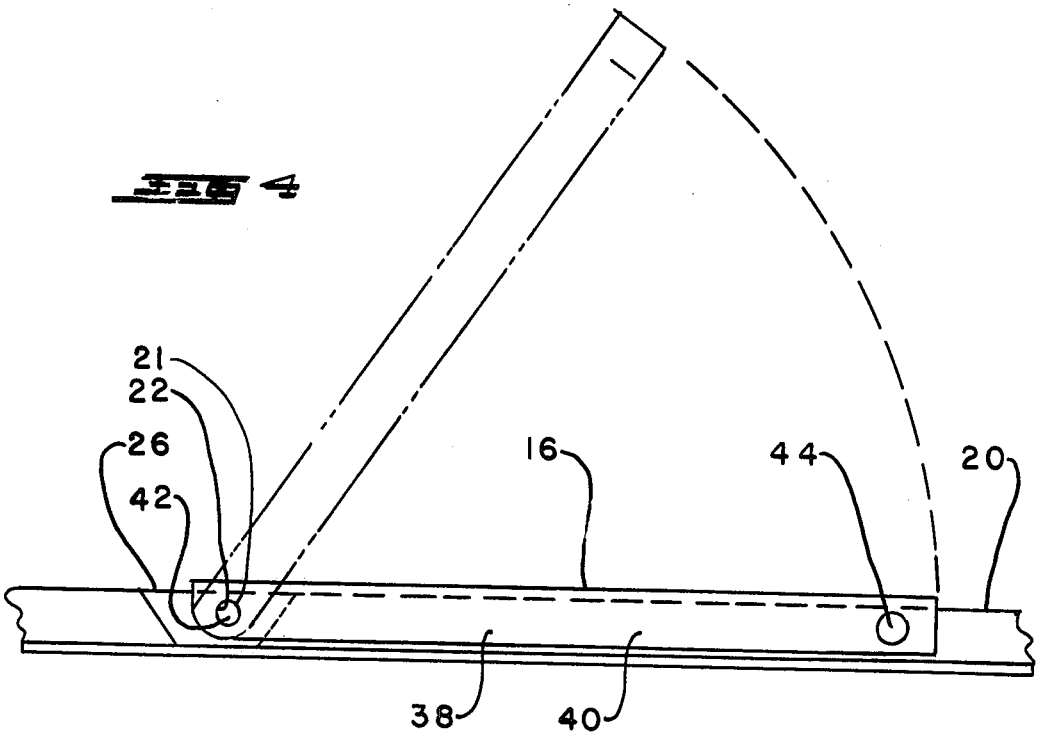
FIG. 4 is an enlarged view of the upper latching mechanism of the instant invention.

Upper latch 16, shown in FIG. 4, is a "U" shaped elongated member that includes downstanding walls 38 and 40. Projecting through both walls are apertures 42 and 44. Latch 16 is pivotally attached to flange 26 by a clevis pin 21 inserted through aligned apertures 22, 28 and 42 of flanges 20, 26 and latch walls 38 and 40.

Figure 5:
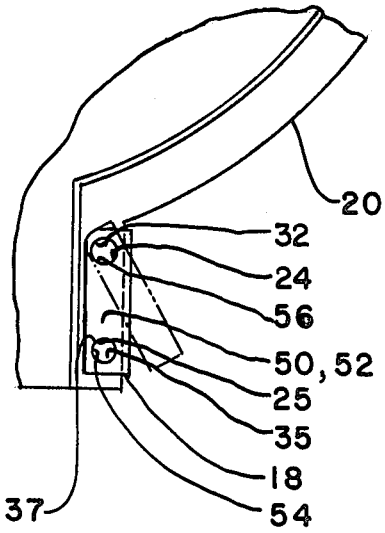
FIG. 5 is an enlarged view of the lower latching mechanism of the instant invention.
Figure 6:
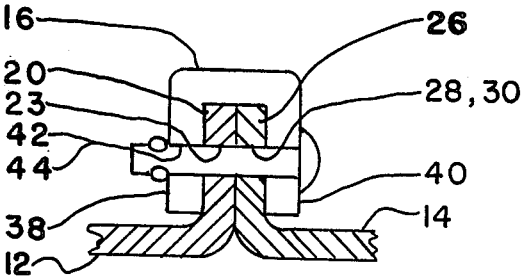
FIG. 6 is a front elevation view of FIGS. 4 and 5.

Lower latch 18, shown in FIG. 5, is a "U" shaped elongated member that includes downstanding walls 50 and 52. Projecting through both walls are apertures 54 and 56. Latch 18 is pivotally attached to flange 26 by a clevis pin 36.

To install ventilator shroud 10 over a ventilator 58, the following procedure is followed. Hemispherical segments 12 and 14 are oriented about ventilator 58 with flanges 20 and 26 in aligned relationship with one-another. The two segments are then brought together until flanges 20 and 26 abut thereby completely enclosing ventilator 58. Segments 12 and 14 are held together as upper latch 16 is pivoted down until walls 38 and 40 slideably engage and retain flanges 20 and 26 in their abutting relationship. When latch 16 is seated on flanges 20 and 26, a clevis pin 34 is inserted through apertures 23, 30 and 44. Lower latch 18 is pivoted inward until walls 50 and 52 slideably engage and retain flanges 20 and 26 in their abutting relationship. When latch 18 is seated on flanges 20 and 26, a clevis pin 37 is inserted through aligned apertures 25, 35 and 54 of flanges 20, 26 and latch walls 50 and 52.

The ventilator shroud 10 is now completely assembled about ventilator 58 and will protect the ventilator from the elements and prevent heat loss in cold weather.

What is claimed is:

1. An enclosure for a roof ventilator comprising:

a first semi-hemispherical shell having its uppermost portion closed and its lowermost portion defining a semi-circular opening of substantially smaller diameter than the diameter of said shell and projecting downward from the periphery of said opening is a collar, and wherein said shell includes an outward projecting flange along its outer periphery thereof;

a second semi-hemispherical shell having its uppermost portion closed and its lowermost portion defining a semi-circular opening equal in size to said opening in said first shell and projecting downward from the periphery of said opening is a collar, and wherein said second shell includes an outward projecting flange along its outermost periphery, and wherein said second shell is intimately attachable to said first shell thereby defining a complete enclosure having a contour substantially approximating the contour of the roof ventilator; and engaging means pivotally attached to said flange of said first shell for engaging said flange of said second shell, said engaging means includes a pivotal channel shaped member and wherein the side flanges of said channel, in the latching mode, overlie portions of said projecting flange for maintaining intimate contact of said flanges.

* * * * *